United States Patent [19]

Ichioka et al.

[11] 3,948,140

[45] Apr. 6, 1976

[54] PORTABLE DEVICE FOR GENERATING AND TUNING A WHOLE TONE SCALE

[75] Inventors: Satoshi Ichioka; Shinjiro Takeuchi, both of Toda; Tadashi Inoue, Tokyo; Tomokazu Katsuragawa, Toda, all of Japan

[73] Assignee: Mishima Kosan Co., Ltd., Kitakyushu, Japan

[22] Filed: Aug. 28, 1974

[21] Appl. No.: 501,452

[30] Foreign Application Priority Data

Aug. 30, 1973 Japan ..... 48-97531

[52] U.S. Cl. ..... 84/454; 324/79 R

[51] Int. Cl.[2] ..... G10G 7/02

[58] Field of Search ..... 84/454–458; 324/79 R, 79 P

[56] References Cited

UNITED STATES PATENTS

| | | | |
|---|---|---|---|
| 2,901,699 | 8/1959 | Motz | 84/454 |
| 2,909,727 | 10/1959 | Andersen | 84/454 |
| 2,958,250 | 11/1960 | Poehler | 84/454 |
| 3,180,199 | 4/1965 | Anderson | 84/454 |
| 3,230,614 | 1/1966 | Rasch | 84/454 |
| 3,433,116 | 3/1969 | Althoff | 84/454 |
| 3,509,454 | 4/1970 | Gossel | 324/79 R |
| 3,722,353 | 3/1973 | Nesthaver | 84/454 |
| 3,766,818 | 10/1973 | Prohofsky | 84/454 |
| 3,795,169 | 3/1974 | Belcher | 84/454 |

*Primary Examiner*—L. T. Hix
*Assistant Examiner*—Vit W. Miska
*Attorney, Agent, or Firm*—Wenderoth, Lind & Ponack

[57] ABSTRACT

A portable device for generating and tuning a whole tone scale comprising means for generating a signal having a frequency of a reference tone scale, first means for shaping an output of the signal generating means and means for converting the output of the first shaping means. The device further includes means for converting the audible tone of a musical instrument to be tuned into a train of electrical signals, means for frequency multiplying and dividing input signals, second means for shaping the output of the converting means, logic means for logically comparing the outputs of the first and the second shaping means to generate a train of signals each having a width corresponding to the frequency difference between the outputs of the first and the second shaping means, and means for indicating the output of the logic means.

1 Claim, 3 Drawing Figures

PORTABLE DEVICE FOR GENERATING AND TUNING A WHOLE TONE SCALE

BACKGROUND OF THE INVENTION

The present invention relates to a portable device for generating and tuning a whole tone scale for correctly tuning and inspecting the scale of a musical instrument or the like.

As conventional tuners (tuning devices for musical instruments), there are stroboscopes, oscilloscopes and the like, which only require the sense of sight, but all of them are large and heavy, so that they are difficult to carry, limited in the places where they can be used, and are inconvenient to operate. Further, they are expensive.

An object of the present invention is to provide a portable device for generating and tuning a whole tone scale which is light-weight and obviates the above-mentioned various defects.

According to the present invention, in order to correctly tune and inspect the scale of a musical instrument and the like, 12 signals corresponding to tones of a scale from $A_4$ to $A_5$ # (1 octave) can be generated by an oscillator for stepwisely varying the frequency according to the frequency of the tones of the scale. These 12 signals converted to actual sound through a speaker, and deviation of these sounds and the tone to be tuned is recognized as a beat by the sense of hearing and the tuning is carried out. Further, in order to tune a tone of a musical instrument with 12 tones of a scale from $A_4$ to $A_5$ # of the device for generating and tuning the whole tone scale, a low tone portion of the instrumental sound is multiplied and a medium and high tone portion is divided, the thus multiplied and divided tone or signal and the 12 scale signals are supplied to a logic circuit, where a signal of corresponding to the frequency difference of these signals is luminously indicated as a beat by means of a luminous means such as a luminous diode and the tuning of the diatonic scale is carried out by the sense of sight.

Description of Preferred Embodiment

Figure 1:
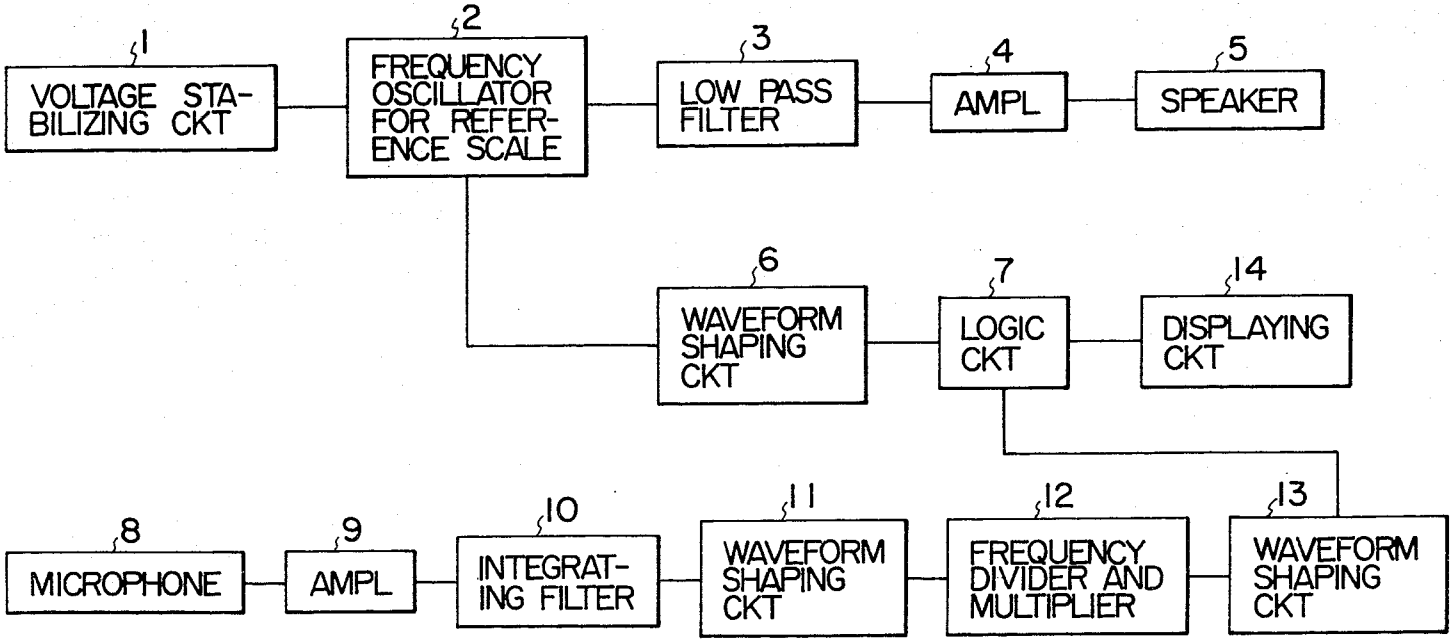
FIG. 1 is a block diagram showing the construction of a portable device for generating and tuning a whole tone scale according to the present invention.
Figure 2A:
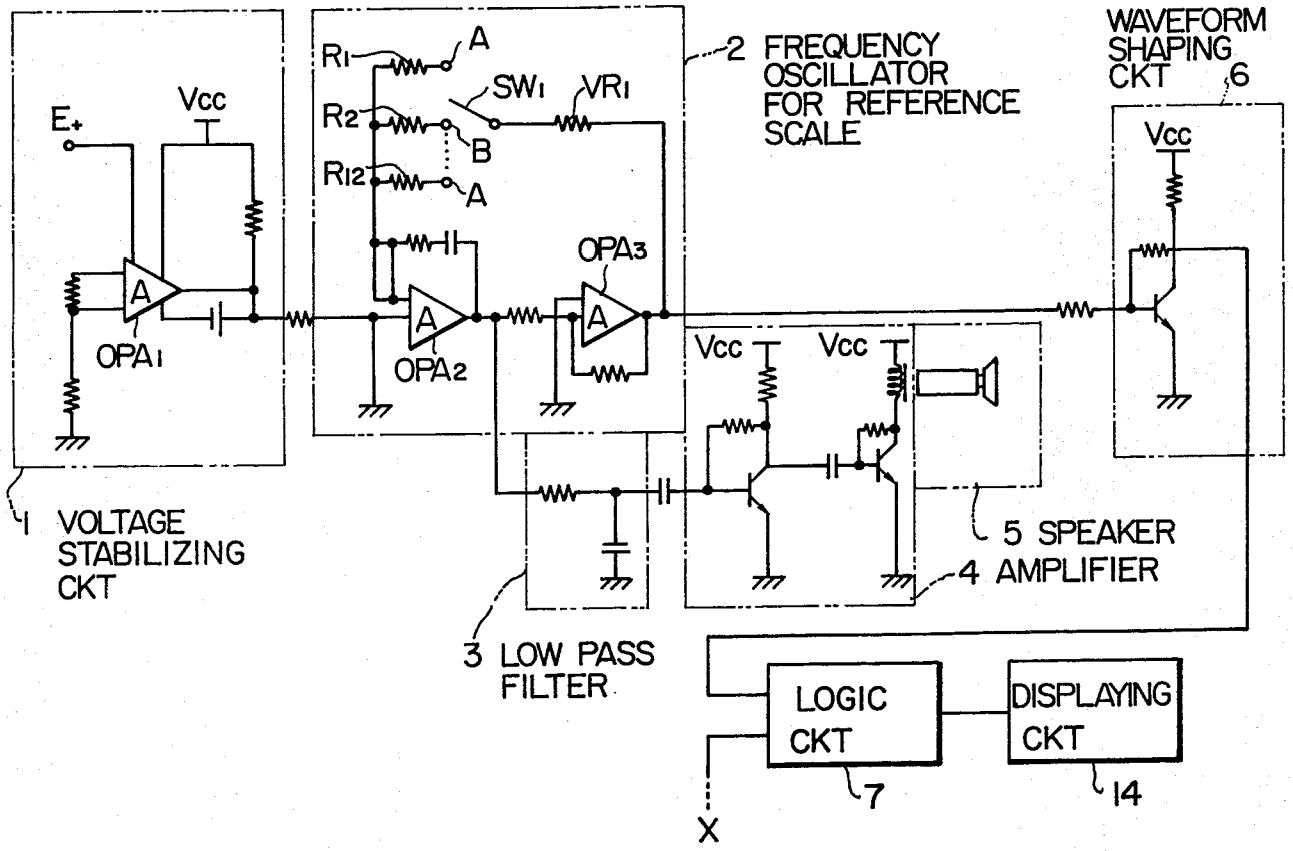
FIGS. 2*a* and 2*b* are detailed circuit diagrams of the device shown in FIG. 1.
Figure 2B:
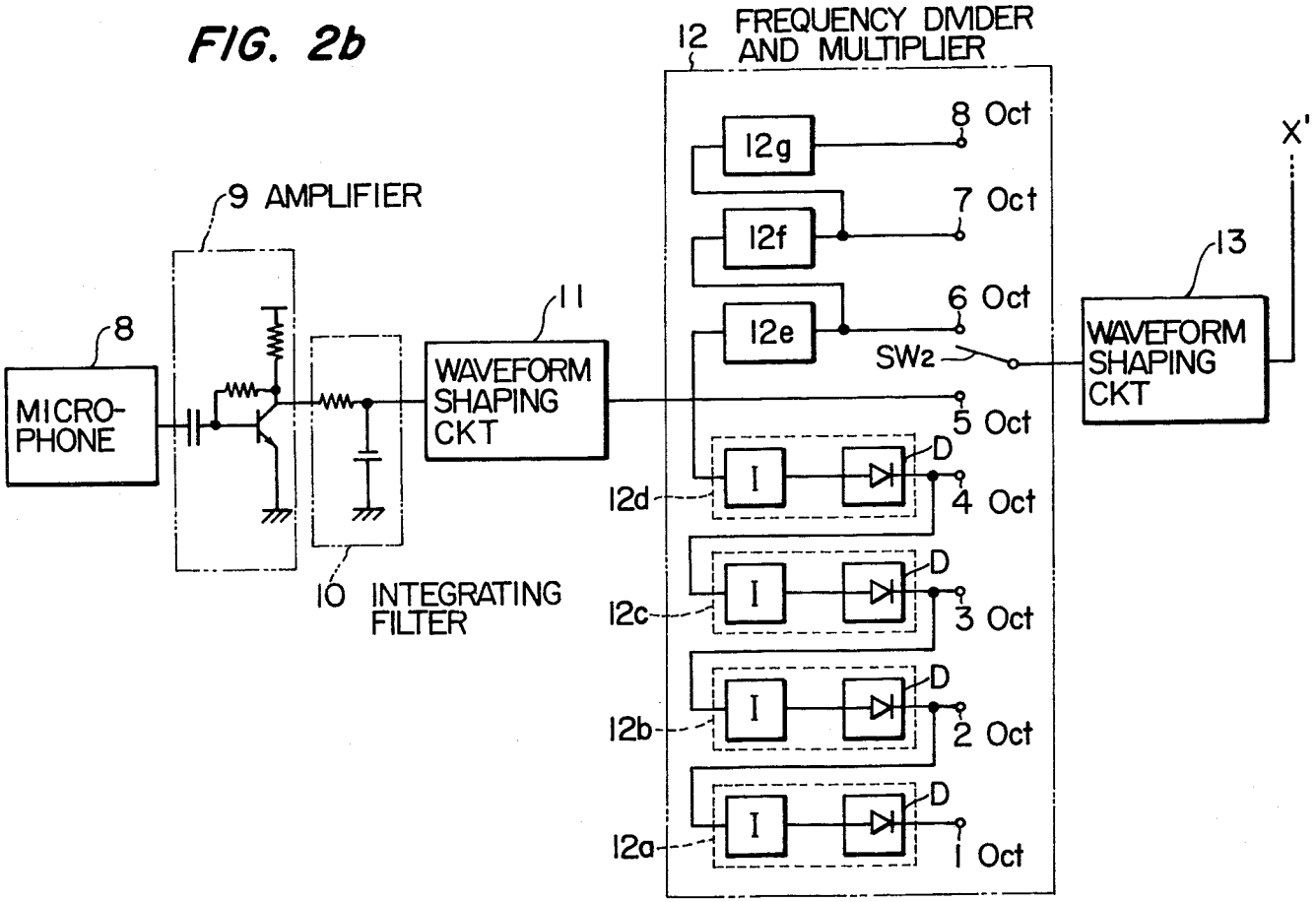

In the portable device for generating and tuning a whole tone scale according to the present invention shown in FIGS. 1, 2*a* and 2*b*, there is provided a constant voltage stabilizing circuit 1 mainly consisting of an operational amplifier OPA 1, its output is supplied to a frequency oscillator 2 for the reference scale, whereby a rectangular wave and triangular wave are simultaneously generated.

This frequency oscillator 2 consists of two operational amplifiers OPA 2 and OPA 3 connected in series, twelve resistances R1 – R12 connected in parallel at one input side of the above operational amplifier OPA 2 for generating 12 chromatic scale signals to scale notes $A_4$ # – $A_5$, and a feedback circuit for connecting these resistances to the output side of the operational amplifier OPA 3 through a variable resistance VR1 and the switch SW1 for varying a pitch. With the use of this switch SW1, 12 scale signals can be stepwisely produced each differing by a half tone.

The triangular wave output signal of the operational amplifier OPA 2 is converted into a sine wave by means of a low pass filter 3 and amplified by an amplifier 4, then supplied to a speaker 5 so that the 12 tones of the reference scale are generated from the loudspeaker 5 as desired. Accordingly, a person using the device should listen to a beat caused by a frequency difference between the sound from the speaker 5 and the sound to be tuned from the instrument with his ear and he can then tune the instrument as he desires.

According to the present invention, which is different from a conventional case which uses an earphone, both the sound from the speaker and the sound to be tuned are heard by air propagation, so that not only the same frequency sound but also a sound an octave or octaves higher or lower than the reference scale, can be sensed as a beat.

Further, in the present invention, the rectangular wave output signal of the operational amplifier OPA 3 is converted into a pulse signal by means of a wave-form shaping circuit 6, and these pulse signals are supplied to one of the inputs of a logic circuit 7. To the other input of the logic circuit 7 is supplied a wave-shaped pulse signal corresponding to the tone to be tuned. The means for converting the sound tone to be tuned of the instrument as seen in FIG. 26, is converted into an electric signal by means of a microphone 8, the thus converted electric signal is amplified by an amplifier 9, and thereafter it is supplied to an integration type filter group 10 (only one filter element in the group is shown in the drawing).

This filter group 10 consists of a plurality of integration type filter elements, these filter elements are properly switched by a switch (not shown) and when going to a higher sound tone portion, the number of the stages of the filter elements is reduced, while when going to a lower sound tone portion, the number of the stages of filter elements is increased. This switch (not shown) is interlinked with the above-mentioned switch SW1. An output of the filter group 10 is converted into a rectangular wave-form by means of a wave shaping circuit 11 and supplied to a frequency multiplier and divider 12. This frequency multiplier and divider 12 consists of frequency multiplier groups 12*a* – 12*d* formed by series connecting 4 frequency multipliers each consisting of a series combination of an integrator and a diode D for the first to the fourth octave, i.e., the low frequency portion, and frequency divider groups 12*e* – 12*g* formed by series connecting three frequency dividers for the fifth to eighth octaves, i.e., the medium and high frequency portion. Outputs of each element 12*a* – 12*g* of this frequency multiplier and divider 12 are supplied to the wave-form shaping circuit 13 through a switch SW2 and converted into a pulse signal, and this pulse signal is supplied to the other input of the above-mentioned logic circuit 7. This logic circuit is formed by suitably combining an AND gate, a NAND gate, an OR gate and a NOR gate, and when input signals arrive at the two inputs at the same time, a beat is generated by the frequency difference of these input pulse trains, the signal corresponding to this frequency difference is supplied to an indicating circuit 14 composed of at least one luminous diode (not shown), so as to flash the luminous diode, and at the point when this flashing of the diode stops the tuning is completed.

As described above, according to the present invention, with the use of only an oscillator for 12 scale tones corresponding to one octave of a medium frequency scale, for example $A_4$– $A_5$ #, having a simple structure, the tuning and inspection can be carried out with high precision by both the sense of hearing and the sense of sight, while with the use of only the reference frequency oscillator for the 12 scale tones, the tuning of the diatonic scale can be carried out. Further, the construction is simplified and the size can be minimized, so that use is remarkably widened.

Further, according to the present invention, by providing a variable resistance VR1 in the frequency oscillator 12 for generating the reference scale, the pitch of the tone can be changed, so that the tuning and inspection becomes easier and quicker.

What is claimed is:

1. A portable device for generating and tuning a whole tone scale, comprising:

a means for converting and wave shaping a sound tone of a musical instrument to be tuned into an input electric signal to be tuned; a frequency multiplying and dividing means coupled to said converting and wave shaping means for generating a signal having frequencies corresponding to scale tones $A_4$ to $A_5$ # by multiplying the frequency of the intput signal when said sound tone to be tuned has a lower frequency than the frequency of said tones $A_4$ to $A_5$ # and by dividing the frequency of the input signal when said sound tone to be tuned has a higher frequency than the frequency of said tones $A_4$ to $A_5$ #; a pulsating circuit connected to said frequency multiplying and dividing means for converting the output of said frequency multiplying and dividing means into a pulse train signal; a reference scale frequency oscillating means for generating signals corresponding to the tone scale $A_4$ to $A_5$ #; a means coupled to said reference scale frequency oscillating means for converting the output of said reference scale frequency oscillating means into a sine wave for driving a loud speaker; a wave form shaping means coupled to said reference scale frequency oscillating means for converting the output of said reference scale frequency oscillating means into a pulse train signal; a logic means coupled to said pulsation circuit and said wave form shaping means for comparing the output of said wave form shaping means and the output of said pulsation circuit; and a means coupled to said logic circuit for visibly indicating the output of said logic means, whereby the diatonic scale of the musical instrument can be tuned and inspected by both the sense of hearing and the sense of sight.

* * * * *